US005632626A

United States Patent [19]

Collins et al.

[11] Patent Number: 5,632,626

[45] Date of Patent: May 27, 1997

[54] RETENTION OF ELASTOMERIC CONNECTOR IN A HOUSING

[75] Inventors: Donnie B. Collins, Tobaccoville; Robert D. Irlbeck, Greensboro; Warren A. Bates, Winston-Salem, all of N.C.

[73] Assignee: The Whitaker Corporation, Wilmington, Del.

[21] Appl. No.: 583,396

[22] Filed: Jan. 5, 1996

[51] Int. Cl.[6] ..... H01R 9/09

[52] U.S. Cl. ..... 439/66; 439/591

[58] Field of Search ..... 439/66, 91, 591, 439/71

[56] References Cited

U.S. PATENT DOCUMENTS 3,998,512 12/1976 Anhalt et al. ..... 439/66

4,012,117 3/1977 Lazzery ..... 439/629

4,344,662 8/1982 Dalamangas et al. ..... 439/91

5,376,008 12/1994 Rodriquez ..... 439/66

*Primary Examiner*—Neil Abrams

*Attorney, Agent, or Firm*—Robert J. Kapalka

[57] ABSTRACT

An electrical connector comprises a dielectric housing having a slot and an elastomeric connector of uniform width disposed in the slot. The slot has a primary section with a width dimensioned such that the elastomeric connector is held relatively loosely in the primary section, and a reduced width section wherein the elastomeric connector is held relatively securely by an interference fit.

10 Claims, 4 Drawing Sheets

RETENTION OF ELASTOMERIC CONNECTOR IN A HOUSING

FIELD OF THE INVENTION

The invention relates to the field of electrical connectors having an elastomeric connector element disposed in a housing, and in particular, to a device for retaining an elastomeric connector element in a housing.

BACKGROUND OF THE INVENTION

With reference to FIG. 1, an elastomeric connector element 10 which is sold under the trademark AMPLIFLEX by AMP Incorporated of Harrisburg, Pa. comprises a thin flexible film member 2 on which is etched a plurality of lines of conductive circuitry 3 and which is wrapped around a resilient core 4 of elastomeric material. The elastomeric element 10 is useful as a component of an electrical connector between two substrates. Such a connector includes a housing 6 having at least one slot 7 in which the elastomeric element 10 is disposed. The housing provides support for the elastomeric element and stabilizes the lines of circuitry for alignment with contact pads on the substrates. The slot is generally long and narrow and has a nominal width which is approximately the same as the width of the elastomeric element so that the elastomeric element will be stabilized in the slot yet not be compressed. The elastomeric element is relatively incompressible and if it is forced into a slot which is too narrow, cracking of the housing could occur.

Heretofore, the elastomeric elements had a laterally extending tab 5 which was formed during manufacture where ends of the flexible film member were bonded together. When the elastomeric element was inserted into the slot, the tab remained extended and would seat on the housing, thus preventing the elastomeric element from exiting through the bottom of the housing. Still, the elastomeric element could be inadvertently dislodged through the top of the housing due to handling, vibration or overturning of the housing.

Further, a problem arises when multiple elastomeric elements are disposed in parallel in a housing on relatively close longitudinal centerlines. Since the tab 5 extends laterally of the longitudinal centerline of its respective elastomeric element, the tab interferes with an adjacent elastomeric element having a closely spaced centerline. In order to permit closer centerline spacing between adjacent elastomeric elements, the elements are now being manufactured without the tab. Since the tab prevented its respective elastomeric element from falling out of the housing, a different means for retaining a tabless elastomeric element in a housing is required.

SUMMARY OF THE INVENTION

It is an object of the invention to secure an elastomeric element in an electrical connector.

It is another object of the invention to provide an electrical connector having multiple elastomeric elements on closely spaced centerlines.

These and other objects are provided by an electrical connector comprising a dielectric housing having a slot and an elastomeric connector disposed in the slot. The elastomeric connector has uniform width. The slot has a primary section with a width dimensioned such that the elastomeric connector is held relatively loosely in the primary section. The slot further has a reduced width section wherein the elastomeric connector is held relatively securely by an interference fit. The housing may have a plurality of such slots arranged on closely spaced centerlines.

BRIEF DESCRIPTION OF THE DRAWINGS

The invention will now be described by way of example with reference to the accompanying drawings in which like elements in different figures thereof are identified by the same reference numeral and wherein.

DETAILED DESCRIPTION OF THE PREFERRED EMBODIMENT

Figure 1:
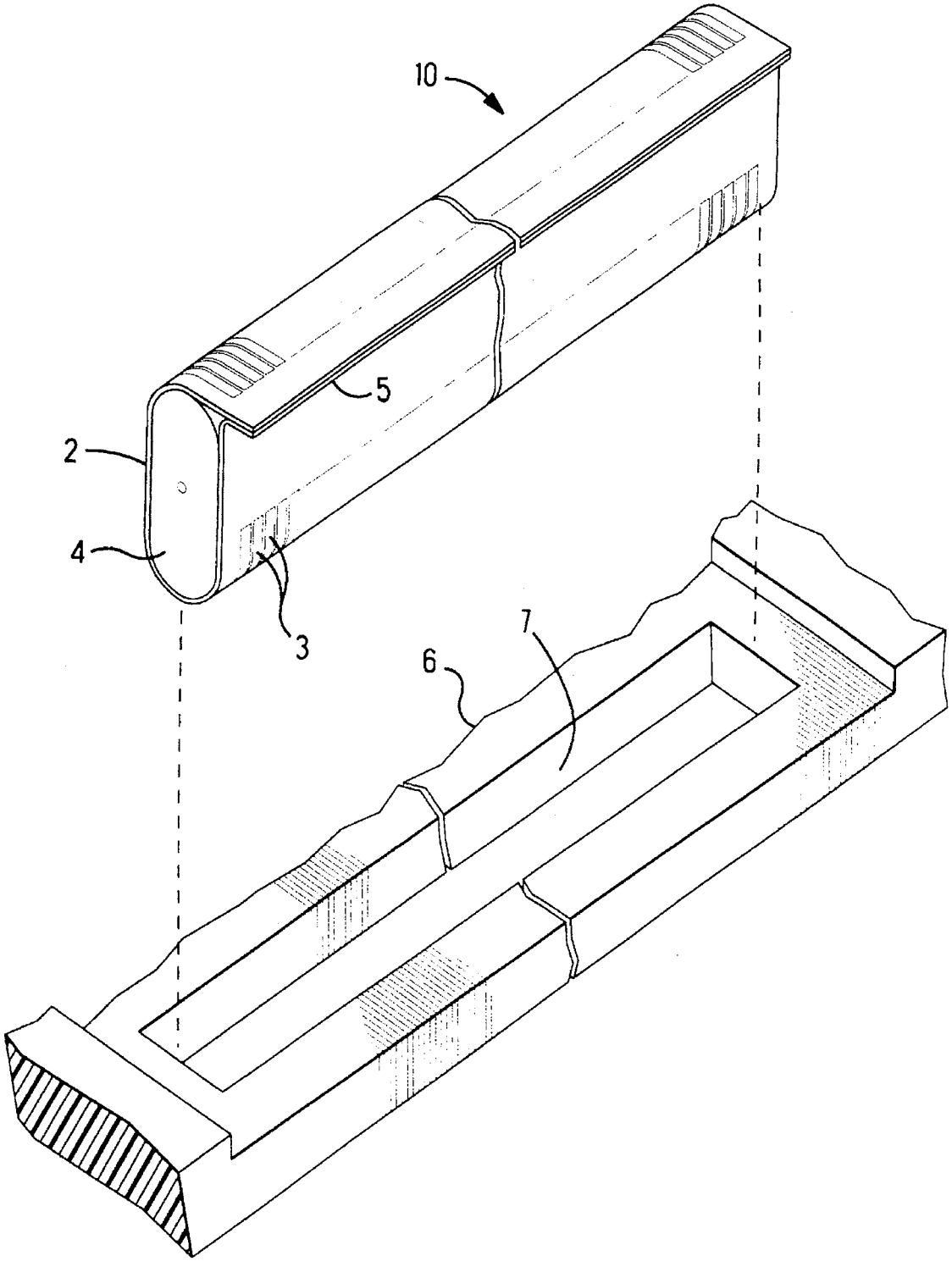
Fig. 1 Prior Art
FIG. 1 is an exploded isometric view of a prior art electrical connector.
Figure 2:
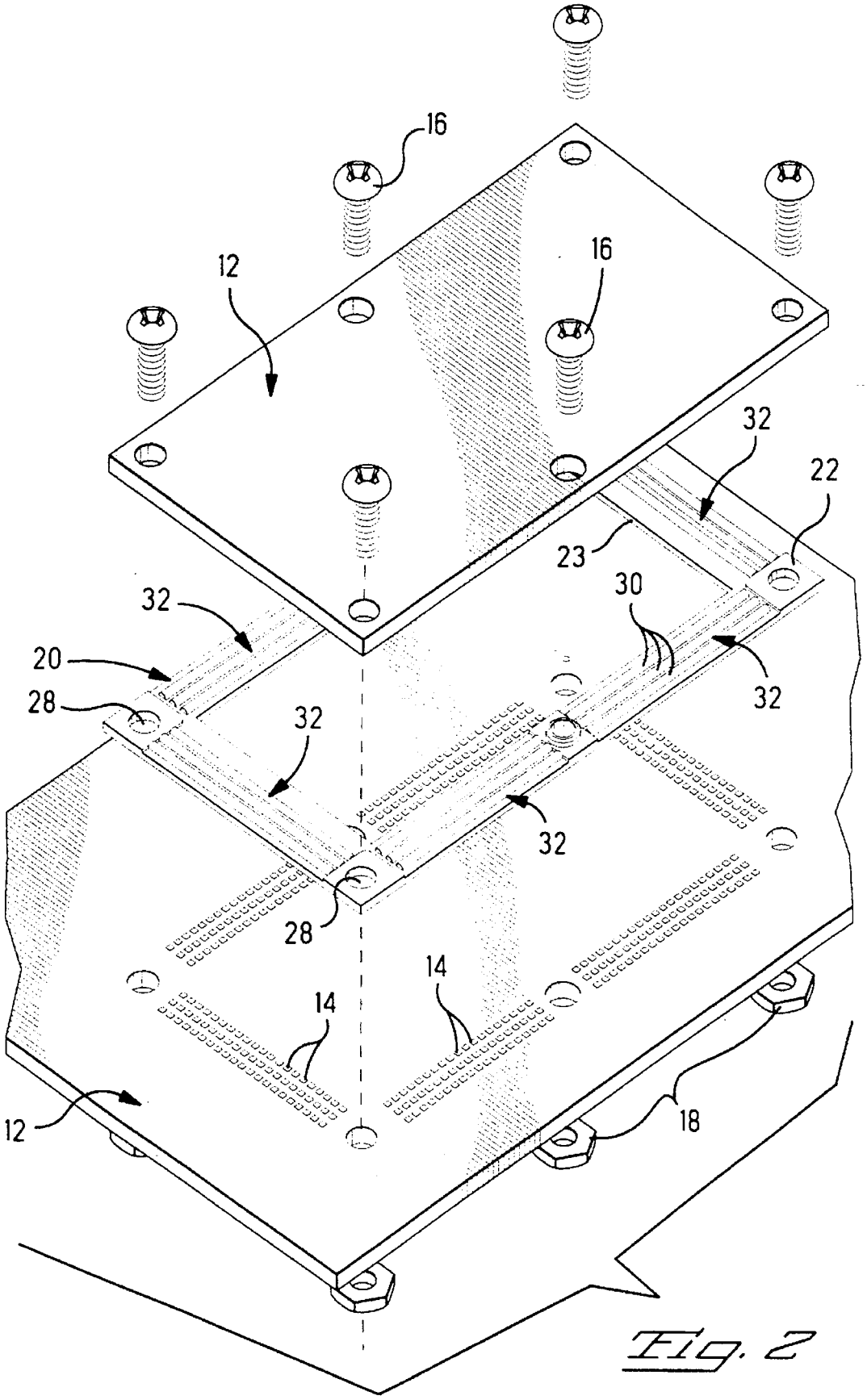
FIG. 2 is an exploded isometric view of an electrical connector according to the invention disposed for interconnecting a pair of substrates.

There is shown in FIG. 2 an electrical connector 20 which is useful for interconnecting a pair of substrates 12 arranged in an opposed parallel relationship. Each of the substrates has an array of contact pads 14 (the pads on the upper substrate being hidden from view) which are terminals of respective circuit lines (not shown) on the substrates. The connector 20 is of the interposer type which is sandwiched between the substrates, and the resulting assembly is secured together such as with threaded fasteners 16 and mating nuts 18.

The connector 20 comprises a dielectric housing 22 which is a relatively flat member holding at least one elastomeric element 30. The housing has a number of through-holes 28 for receiving the fasteners 16 therethrough. In the preferred embodiment shown, the housing is a rectangular frame member having a central opening 23. The housing holds a plurality of the elastomeric elements 30 in an array which includes six sub-arrays 32 each having three of the elastomeric elements in adjacent parallel relationship. Each of the sub-arrays 32 is orthogonal to an adjacent sub-array at a corner of the housing. It should be understood, however, that an electrical connector according to the invention could be manufactured with the housing 22 having a different configuration and a different number and/or arrangement of the elastomeric elements 30, as long as the housing has at least one of the elastomeric elements 30.

Figure 3:
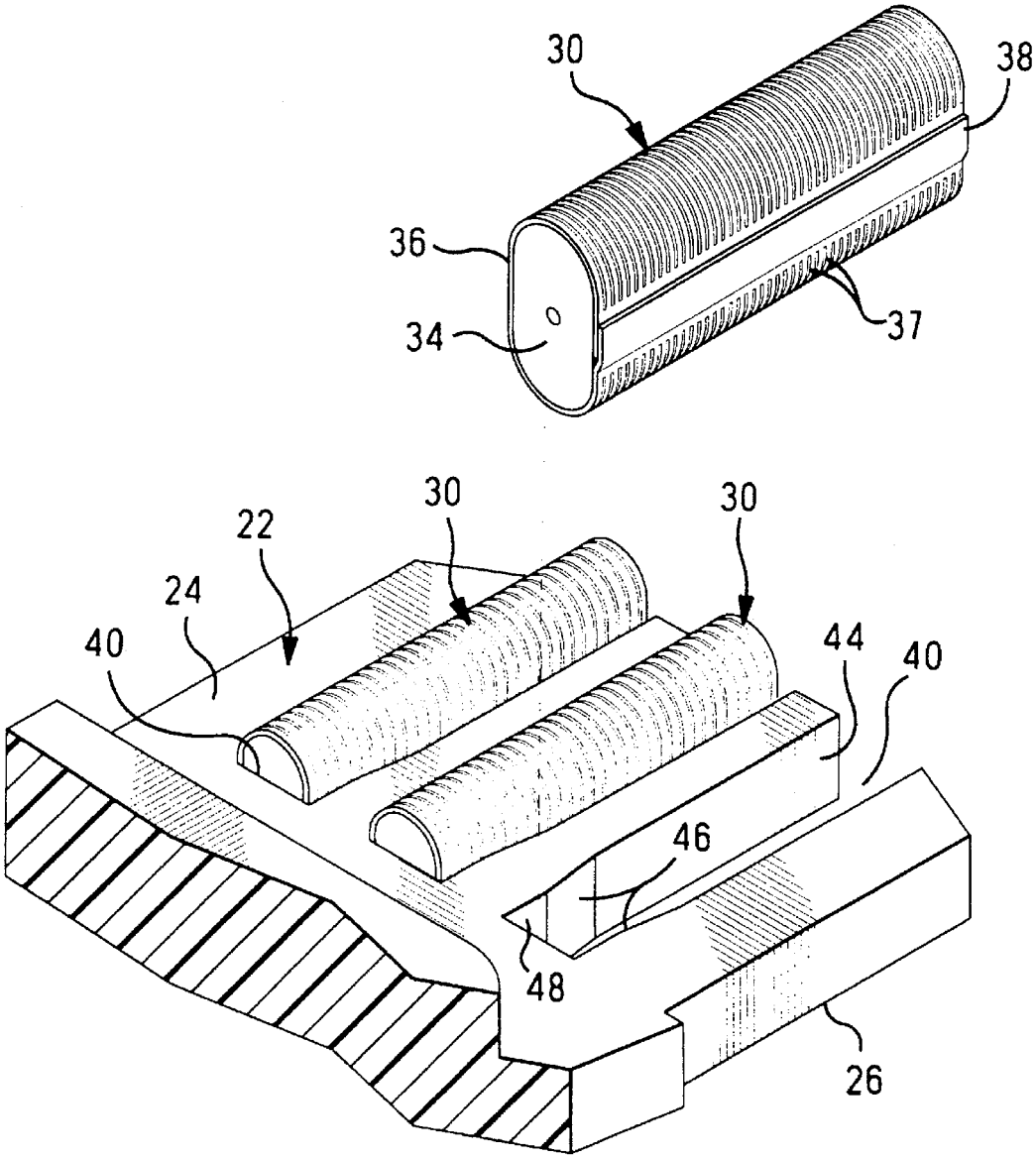
FIG. 3 is an enlarged isometric view of a portion of the electrical connector.

With reference to FIG. 3, the housing 22 has upper and lower surfaces 24, 26, and a plurality of slots 40. Each of the slots 40 extends through the housing from the upper to the lower surface thereof, and each slot is elongated along a longitudinal axis in a plane of the housing. One of the elastomeric elements 30 is disposed in each of the slots 40. Each of the elements 30 has an elastomeric core 34 with an oval-shaped cross-section. A thin flexible film member 36 with conductive circuitry 37 thereon is wound around the core, and circumferential ends of the flexible film member are overlapped and bonded at region 38, thereby providing a tabless elastomeric element.

Figure 4:
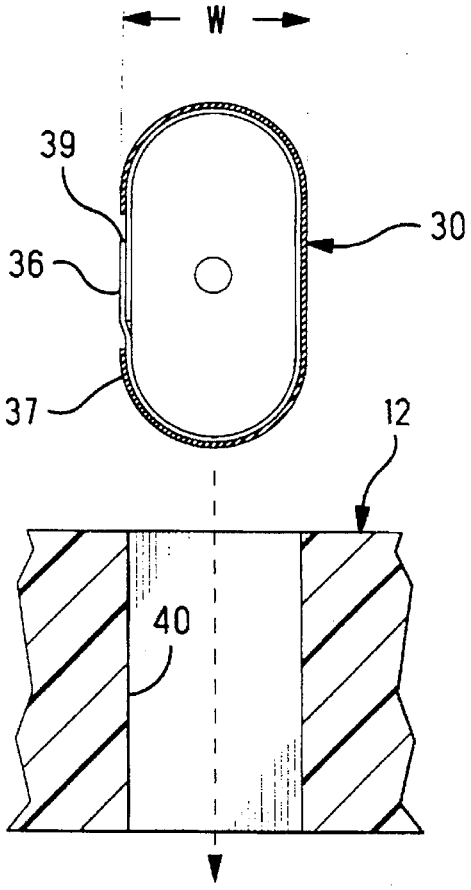
FIG. 4 is a cross-sectional view showing an elastomeric element disposed for insertion in a connector housing.

Referring to FIG. 4, the elastomeric element 30 has a width W which is substantially uniform along the entire length thereof. The slot 40 has a width which is dimensioned to accommodate the element 30 as will be explained. It is preferable to orient the element 30 for insertion into the slot 40 such that edge 39 faces in a direction opposite to the insertion direction so as to avoid interference with an edge of the slot wall.

Figure 5:
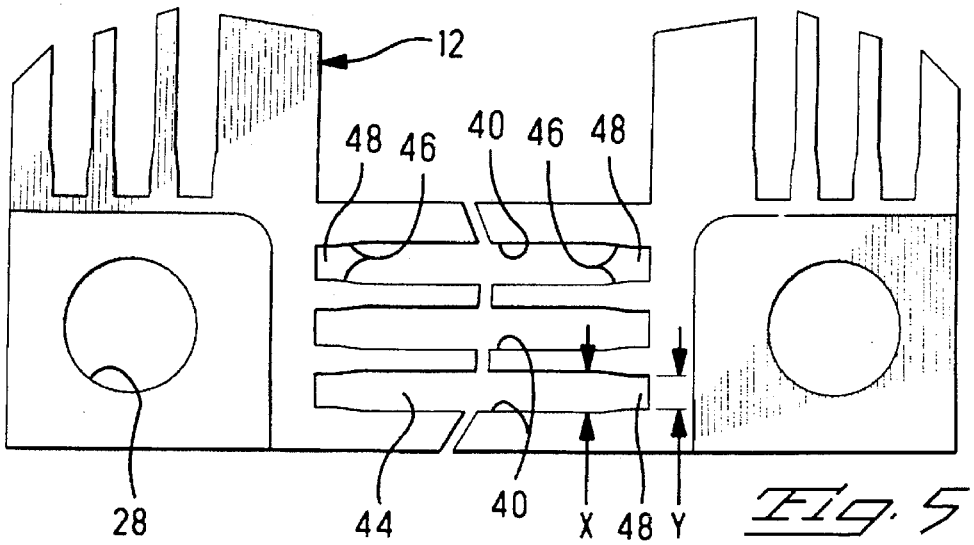
FIG. 5 is a top plan view of a portion of the connector housing.

With reference to FIG. 5, the longitudinally elongated slot 40 has a primary section 44 with a width X which is dimensioned to hold the elastomeric element relatively loosely. Since the elastomeric element is relatively incompressible, the width X is selected to be substantially the same as the width W of the elastomeric element. An acceptable fit for holding the elastomeric element relatively loosely in the primary section is provided by selecting the dimensions X and W to produce a fit within the range of 0.10 mm clearance to 0.04 mm interference. The primary section 44 extends for a majority of the length of the slot. The slot 40 has converging walls 46 which connect the primary section 44 to reduced width sections 48 at both longitudinal ends of the slot. The reduced width sections 48 have a width Y which is selected to hold the elastomeric element relatively securely in an interference fit. An interference fit in the range between 0.04 mm and 0.18 mm is acceptable for this purpose. Thus, the elastomeric element is retained in the slot due to ends of the elastomeric element being pinched in the reduced width sections 48. However, it should be understood that the invention is not limited to a slot having reduced width sections at both longitudinal ends thereof. Instead, the invention may be practiced in conjunction with a slot having a single reduced width section at any location along the length of the slot, or any combination of reduced width sections along the length of the slot.

Figure 6:
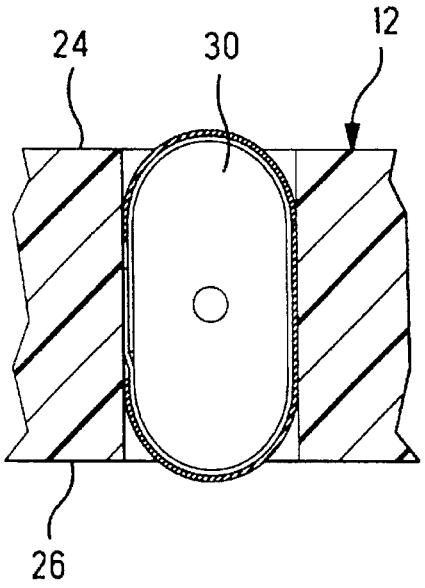
FIG. 6 is a cross-sectional view showing the elastomeric element inserted in the connector housing.

When the elastomeric element is fully inserted in the slot, portions of the element extend beyond the upper and lower surfaces 24, 26 of the housing 12, as shown in FIG. 6, for engagement with contact pads on the substrates to be interconnected.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector comprising:

a dielectric housing having a longitudinally elongated slot and an elastomeric connector disposed in the slot, the elastomeric connector extending for a length between opposite longitudinal ends and having a uniform width, the slot having a primary section with a width dimensioned such that the elastomeric connector is held relatively loosely in the primary section, and the slot having a reduced width section wherein a portion of the length of the elastomeric connector is held relatively securely by an interference fit.

2. The electrical connector according to claim 1, wherein the housing is substantially flat and the slot is longitudinally elongated in a plane of the housing.

3. The electrical connector according to claim 2, wherein the reduced width section includes at least one longitudinal end of the slot.

4. The electrical connector according to claim 2, wherein the reduced width section includes both longitudinal ends of the slot.

5. The electrical connector according to claim 1, wherein the housing has a plurality of said slots arranged orthogonally, and a said elastomeric connector in each of said slots.

6. An electrical connector comprising:

a dielectric housing having an elongated slot with a length and an elastomeric connector disposed in the slot, a portion of the elastomeric connector being compressed between opposed walls in a reduced width section of the slot which extends for only a portion of the length of the slot, whereby the elastomeric connector is secured in the slot.

7. The electrical connector according to claim 6, wherein the housing is substantially flat and the slot is longitudinally elongated in a plane of the housing.

8. The electrical connector according to claim 7, wherein the reduced width section includes at least one longitudinal end of the slot.

9. The electrical connector according to claim 7, wherein the reduced width section includes both longitudinal ends of the slot.

10. The electrical connector according to claim 6, wherein the housing has a plurality of said slots arranged orthogonally, and a said elastomeric connector in each of said slots.

* * * * *